US008860345B2

(12) United States Patent
Boscariol et al.

(10) Patent No.: US 8,860,345 B2
(45) Date of Patent: Oct. 14, 2014

(54) SENSORLESS SAFETY SYSTEM FOR DETERMINING ROTATION OF AN ELECTRIC HOUSEHOLD APPLIANCE LAUNDRY DRUM POWERED BY A THREE-PHASE ASYNCHRONOUS MOTOR

(75) Inventors: Enrico Boscariol, Cordignano (IT); Enrico Marson, Azzano Decimo (IT); Paolo Posa, Cordenons (IT)

(73) Assignee: Electrolux Home Products Corporation N.V., Brussels (BE)

( * ) Notice: Subject to any disclaimer, the term of this patent is extended or adjusted under 35 U.S.C. 154(b) by 23 days.

(21) Appl. No.: 13/383,729

(22) PCT Filed: Jun. 29, 2010

(86) PCT No.: PCT/EP2010/003850

§ 371 (c)(1), (2), (4) Date: Jan. 12, 2012

(87) PCT Pub. No.: WO2011/006582

PCT Pub. Date: Jan. 20, 2011

(65) Prior Publication Data

US 2012/0112675 A1 May 10, 2012

(30) Foreign Application Priority Data

Jul. 14, 2009 (EP) ..... 09009151

(51) Int. Cl.

*H02P 6/00* (2006.01)
*D06F 58/28* (2006.01)
*D06F 37/42* (2006.01)

(52) U.S. Cl.

CPC ..... *D06F 58/28* (2013.01); *D06F 37/42* (2013.01); *D06F 2058/2858* (2013.01)
USPC ..... 318/400.35

(58) Field of Classification Search

USPC ..... 318/400, 563, 400.35, 400.01, 400.02, 318/700; 1/33 R
See application file for complete search history.

(56) References Cited

U.S. PATENT DOCUMENTS 7,296,444 B2 * 11/2007 Mae et al. ..... 68/12.04
7,866,059 B2 * 1/2011 Yoo et al. ..... 34/427

(Continued)

FOREIGN PATENT DOCUMENTS

WO 2007/077113 7/2007

OTHER PUBLICATIONS

International Search Report issued in corresponding International Application No. PCT/EP2010/003850, mailed Feb. 18, 2011.

(Continued)

*Primary Examiner* — Shawki S Ismail
*Assistant Examiner* — Zoheb Imtiaz
(74) *Attorney, Agent, or Firm* — Banner & Witcoff, Ltd.

(57) ABSTRACT

An electric household appliance (1) having a casing (2); a laundry drum (3) mounted inside the casing (2) to rotate about an axis of rotation; a three-phase asynchronous motor (6) for rotating the laundry drum (3); and a sensorless safety system (7) for determining rotation of the rotor (32), to determine rotation or no rotation of the laundry drum (3). The sensorless safety system (7) is designed to supply three direct currents (Ias, Ibs, Ics) to the three stator power phases (31) during a predetermined time interval (ΔT), so as to magnetize the rotor (32); to cut off supply of the direct currents (Ias, Ibs, Ics); to determine the time pattern of at least one of the three induced currents (Iar, Ibr, Icr) induced in the stator (30) in response to magnetizing the rotor (32); and to determine rotation or no rotation of the rotor (32) on the basis of the time pattern of at least one of the three induced currents (Iar, Ibr, Icr).

20 Claims, 4 Drawing Sheets

(56) References Cited

U.S. PATENT DOCUMENTS

| | | | | |
|---|---|---|---|---|
| 2003/0182975 | A1 | 10/2003 | Tomigashi et al. | |
| 2004/0130287 | A1* | 7/2004 | Sadasivam et al. | 318/799 |
| 2006/0284581 | A1* | 12/2006 | Mullin et al. | 318/362 |
| 2008/0238349 | A1* | 10/2008 | Cheng | 318/400.05 |
| 2008/0252244 | A1* | 10/2008 | Palma et al. | 318/400.32 |
| 2009/0039808 | A1* | 2/2009 | Hashimoto | 318/400.02 |
| 2009/0056385 | A1* | 3/2009 | Maekawa | 68/12.16 |
| 2009/0058331 | A1* | 3/2009 | Aoyagi et al. | 318/255 |
| 2009/0115425 | A1* | 5/2009 | Zeh | 324/511 |
| 2009/0126220 | A1 | 5/2009 | Nawrot et al. | |
| 2009/0184674 | A1* | 7/2009 | Weinmann et al. | 318/490 |
| 2010/0092275 | A1* | 4/2010 | Savitz | 415/1 |
| 2010/0117572 | A1* | 5/2010 | Harada et al. | 318/400.11 |
| 2011/0304290 | A1* | 12/2011 | Ito et al. | 318/400.32 |

OTHER PUBLICATIONS

European Search Report issued in corresponding European Application No. 09009151.3, mailed Oct. 5, 2009.

* cited by examiner

SENSORLESS SAFETY SYSTEM FOR DETERMINING ROTATION OF AN ELECTRIC HOUSEHOLD APPLIANCE LAUNDRY DRUM POWERED BY A THREE-PHASE ASYNCHRONOUS MOTOR

BACKGROUND

The present invention relates to a safety system for determining rotation of a laundry drum of an electric household appliance, in particular a washing machine of the type comprising: a casing, in which the laundry drum is mounted to rotate freely; a door connected to the frame to open and close an access opening to the laundry drum; a three-phase asynchronous motor for rotating the laundry drum; and an inverter, in turn comprising a power circuit composed of six transistors arranged in pairs along three circuit branches connected to the three stator phases of the three-phase asynchronous motor, and a control device that controls the six transistors instant by instant to supply the three stator currents to the motor to generate a rotating magnetic field by which to rotate the rotor.

As is known, washing machine safety systems of the above sort are designed to measure the rotor rotation speed of the three-phase asynchronous motor to determine whether or not the laundry drum is rotating. The information acquired by the safety system relative to rotation or no rotation of the rotor is normally sent to a central control unit which monitors the washing machine and authorizes, or not, safe opening of the door in the event of power failure.

More specifically, in the event of power failure, if the central control unit monitoring the washing machine determines rotation of the laundry drum, it temporarily prevents the laundry drum door from being opened, to prevent the user from accidentally coming into contact with the rotating drum. In fact, the laundry-drum usually has a relatively high value of inertia which causes rotation of the drum for a considerable time interval after a power failure.

For this purpose, some currently marketed safety systems comprise sensors fitted to the motor to measure rotor speed; and a computing module, which determines rotation of the rotor when the speed measured by the sensors is other than zero.

Though efficient and reliable, safety systems of the above type have the drawback of requiring the use of speed sensors, which, besides complicating system hardware, have a far from negligible effect on the overall cost of the safety system.

Accordingly, sensorless solutions have been devised, in which the inverter control device is designed to estimate rotor rotation speed on the basis of the stator currents and voltages, and as a function of a mathematical model of the electric behaviour of the three-phase asynchronous motor.

More specifically, an induction motor can be represented by a system of equations, in which the voltage impressed by the inverter and the motor phase current readings are the inputs, and the rotor speed is the output; and the parameters of the equation are the stator and rotor resistance, and the stator and rotor inductance. Given these parameters, speed can be estimated and implemented in the control device.

Though safely determining rotation or no rotation of the laundry drum on the basis of estimated speed, the above control device is not so reliable in determining rotation or no rotation in the event of power failure.

That is, in the event of power failure, the control device temporarily loses the stator current or voltage references used to drive the motor, and so is unable to make a correct estimate of rotor rotation speed. In which case, the control device resets itself to reset control of the motor, by assuming a stationary-rotor reset condition.

In other words, though efficient and reliable in determining rotation or no rotation of the rotor in "normal" operating conditions, the above control device fails to ensure the same in the event of power failure, thus impairing the safety of the washing machine.

SUMMARY OF SELECTED INVENTIVE ASPECTS

It is therefore an object of the present invention to provide a washing machine featuring a sensorless safety system, which is cheap to produce and reliable in determining rotation of the laundry drum in the event of power failure.

According to the present invention, there is provided an electric household appliance as claimed in Claim 1 and preferably, though not necessarily, in any one of the Claims depending directly or indirectly on Claim 1.

According to the present invention, there is also provided a method of determining rotation of an electric household appliance laundry drum, as claimed in Claim 7 and preferably, though not necessarily, in any one of the Claims depending directly or indirectly on Claim 7.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 1:
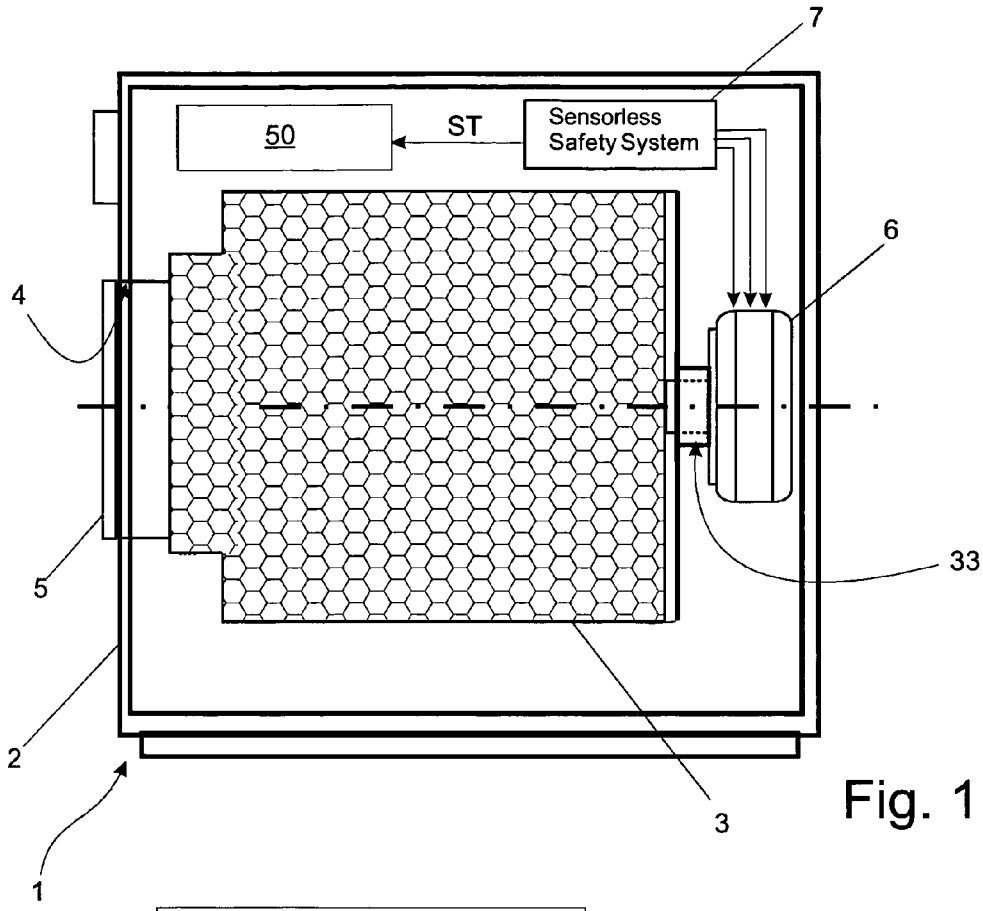
FIG. 1 shows a schematic side view, with parts removed for clarity, of a washing machine featuring a sensorless safety system in accordance with the teachings of the present invention.

Number 1 in FIG. 1 indicates as a whole an electric household appliance substantially comprising an outer casing 2; a laundry drum 3 mounted inside casing 2 and directly facing a laundry loading/unloading opening 4 formed in casing 2; and a door 5 connected to casing 2 and movable, e.g. rotated, between an open position and a closed position opening and closing opening 4 respectively.

Appliance 1 also comprises a three-phase asynchronous motor 6 which, being known, is not described in detail, except to state that it comprises a stator 30 having three stator phases 31; and a rotor 32 mounted to rotate freely inside stator 30 and connected to laundry drum 3 by a known motion transmission member 33 to rotate laundry drum 3.

Appliance 1 also comprises a sensorless safety system 7 for determining rotation of the rotor of three-phase asynchronous motor 6 to determine rotation or no rotation of laundry drum 3 after the end of a power failure.

It should be pointed out that the laundry drum usually has a relatively high value of inertia which causes rotation of drum for a considerable time interval after a power failure.

Unlike the sensorless safety systems installed in known washing machines, sensorless safety system 7 according to the present invention is designed to supply, during a predetermined magnetizing time interval ΔT, three direct currents Ias, Ibs, Ics to the three stator power phases 31 of three-phase asynchronous motor 6 to magnetize rotor 32 of three-phase asynchronous motor 6.

Sensorless safety system 7 is also designed to cut off supply of direct currents Ias, Ibs, Ics to stator 30 at the end of predetermined magnetizing time interval ΔT, and determines the time pattern of at least one of the three currents Iar, Ibr, Icr induced by rotor 32 in stator 30 in response to magnetization by injection of direct currents Ias, Ibs, Ics.

Sensorless safety system 7 is also designed to determine rotation or no rotation of rotor 32 of three-phase asynchronous motor 6 as a function of the time pattern of at least one of the three induced currents Iar, Ibr, Icr determined.

More specifically, sensorless safety system 7 determines rotation of the rotor of three-phase asynchronous motor 6, when at least one of the currents Iar, Ibr, Icr induced in stator 30 by the magnetized rotor 32 shows a substantially alternating pattern decreasing with time.

Figure 4:
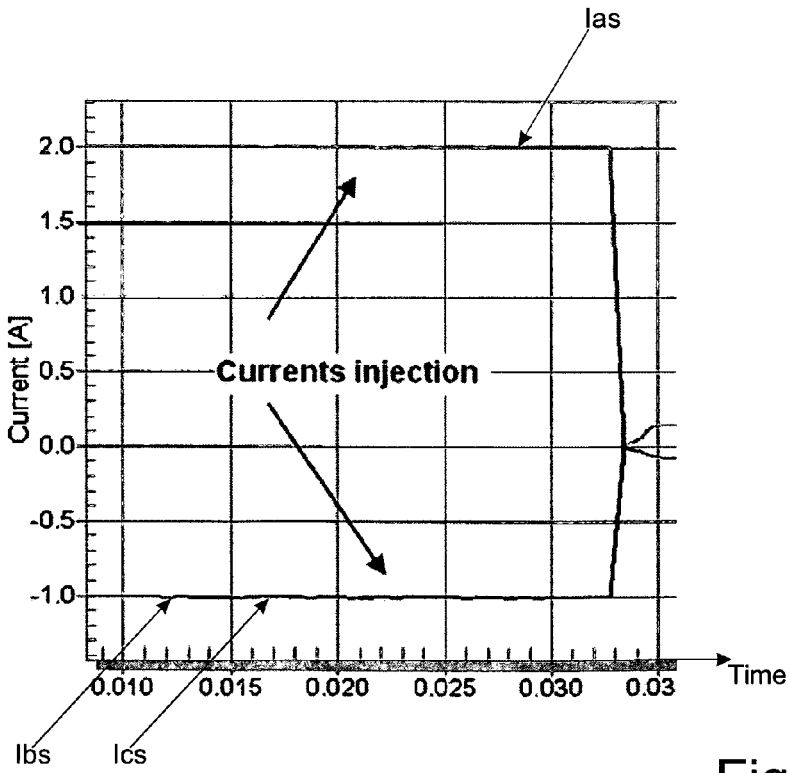
FIG. 4 shows a time graph of the currents injected into the stator by the FIGS. 2 and 3 sensorless safety system.
Figure 6:
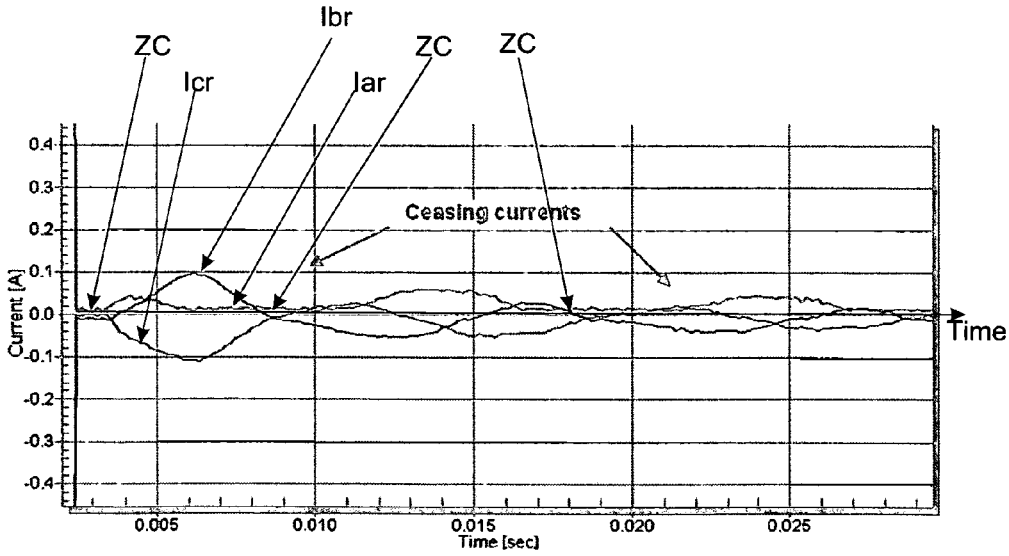
FIG. 6 shows a time graph of the currents induced in the stator by a rotating rotor.

More specifically, FIG. 4 shows an example time graph of injected currents Ias, Ibs, Ics; and FIG. 6 shows an example time graph of the currents Iar, Ibr, Icr induced in the stator by the magnetized rotor when the rotor is rotating. It should be pointed out that the time pattern of currents Iar, Ibr, Icr induced in the stator by the rotating magnetized rotor is substantially sinusoidal, and gradually decreases exponentially with time, with a number of zero crossings ZC.

In the embodiment shown in the drawings, sensorless safety system 7 is advantageously designed to determine the alternating time pattern, corresponding to rotation of rotor 32 after the end of a power failure, when, following injection of direct currents Ias, Ibs, Ics, it determines the presence of zero crossings ZC of induced currents Iar, Ibr, Icr.

Sensorless safety system 7 is also designed to determine no rotation of rotor 32 of three-phase asynchronous motor 6 after the end of a power failure, when the pattern of at least one of currents Iar, Ibr, Icr induced by rotor 32 in stator 31 of three-phase asynchronous motor 6 decreases substantially exponentially with time.

Figure 5:
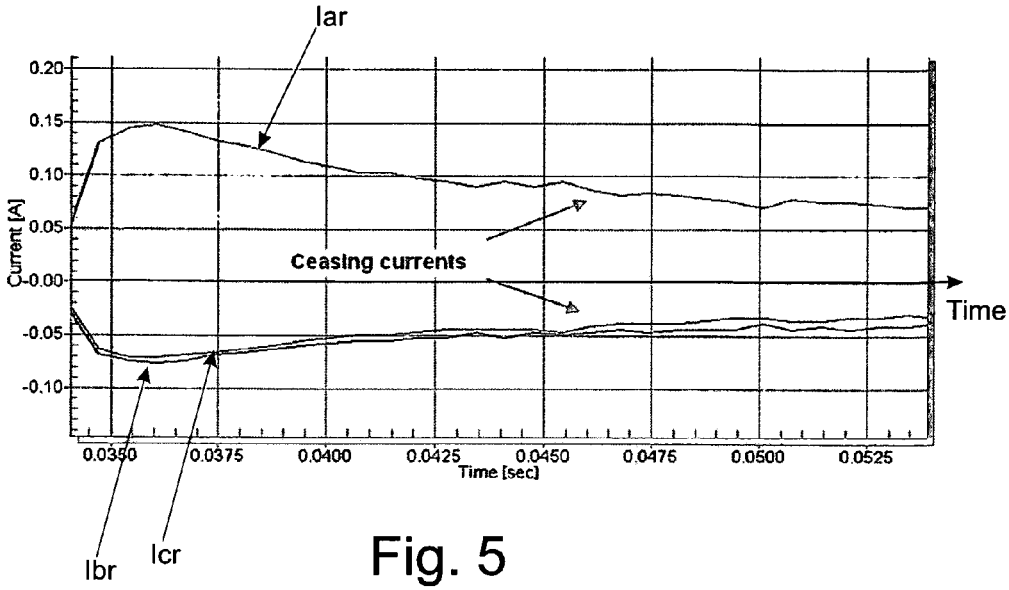
FIG. 5 shows a time graph of the currents induced in the stator by a stationary rotor.

More specifically, FIG. 5 shows an example time graph of injected currents Ias, Ibs, Ics and currents Iar, Ibr, Icr induced in the stator by the stationary magnetized rotor. It should be pointed out that the time pattern of currents Iar, Ibr, Icr induced in the stator by the stationary magnetized rotor decreases exponentially with no zero crossings ZC.

In the embodiment shown in the drawings, sensorless safety system 7 is advantageously designed to determine the exponentially decreasing time pattern, corresponding to no rotation of the rotor, when, following injection of direct currents Ias, Ibs, Ics, it determines no zero crossings ZC of induced currents Iar, Ibr, Icr.

Figure 2:
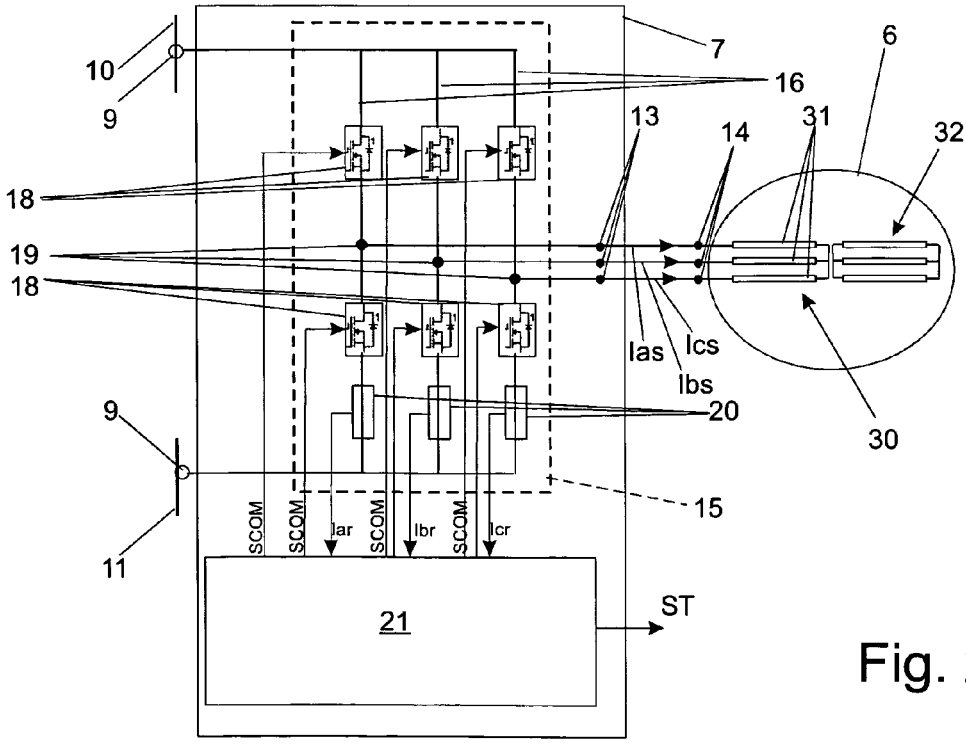
FIG. 2 shows a block diagram of the FIG. 1 appliance sensorless safety system when magnetizing the rotor.
Figure 3:
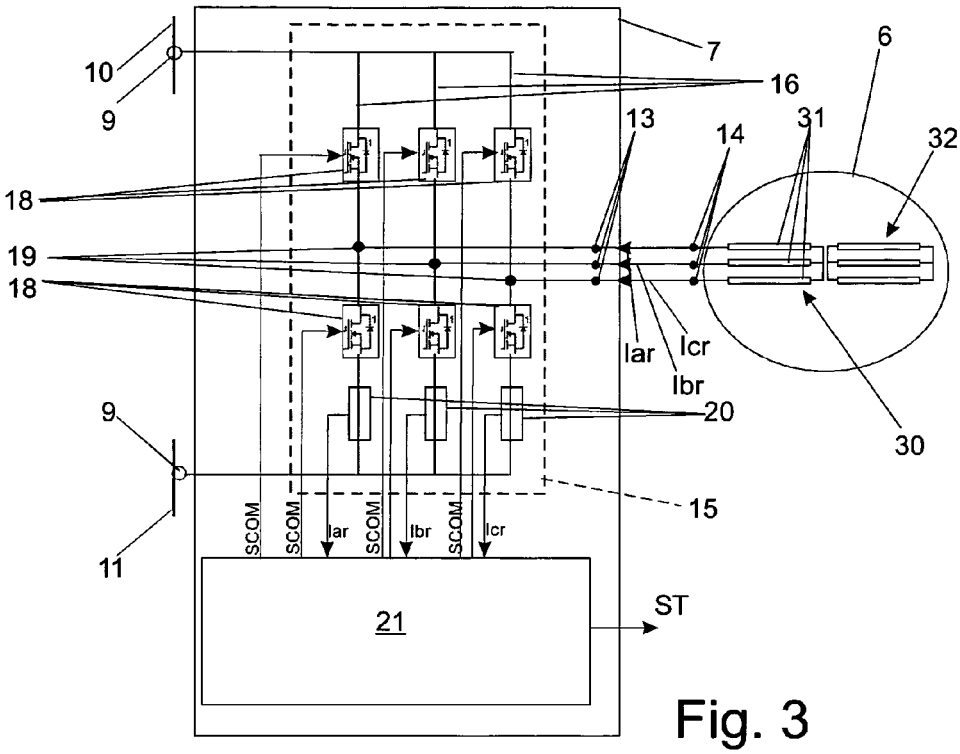
FIG. 3 shows a block diagram of the FIG. 1 appliance sensorless safety system when determining the currents induced in the stator in response to current injection.

FIGS. 2 and 3 show a preferred embodiment of sensorless safety system 7, which substantially comprises a power circuit 15 having two supply terminals 9 connected respectively to a first and second supply line 10, 11 at a substantially direct supply voltage; and three control terminals 13 connected respectively to the three stator phases 31 via three terminals 14 of three-phase asynchronous motor 6.

More specifically, power circuit 15 has three drive circuit branches 16 connected to the two supply lines 10 and 11, and each comprising two electronic switches 18, e.g. transistors, and an intermediate node 19 located between the two switches 18 and connected to a respective stator phase 31 via a respective terminal 14 of three-phase asynchronous motor 6.

More specifically, intermediate node 19 connects a high-side switch 18 in the top portion of circuit branch 16 to a low-side switch 18 in the bottom portion of circuit branch 16.

Sensorless safety system 7 also comprises three current-measuring modules 20, which are located along the three circuit branches 16, preferably but not necessarily in the bottom portion of circuit branches 16, to measure instant by instant the currents circulating through stator phases 31.

In the FIG. 3 example, modules 20 comprise shunts that measure currents Iar, Ibr, Icr induced in stator 30 by the magnetized rotating rotor 32.

Sensorless safety system 7 also comprises a control unit 21 designed to: supply transistors 18 with control signals SCOM to conduct/disable the transistors; receive currents Iar, Ibr, Icr measured by the shunts; and generate a state signal ST indicating rotation or no rotation of rotor 32 of three-phase asynchronous motor 6.

More specifically, control unit 21 preferably comprises a microprocessor, e.g. a DSP, designed to implement a procedure for determining rotation or no rotation of the rotor of three-phase asynchronous motor 6 at the end of a power failure, and which performs the operations described in detail below.

Figure 7:
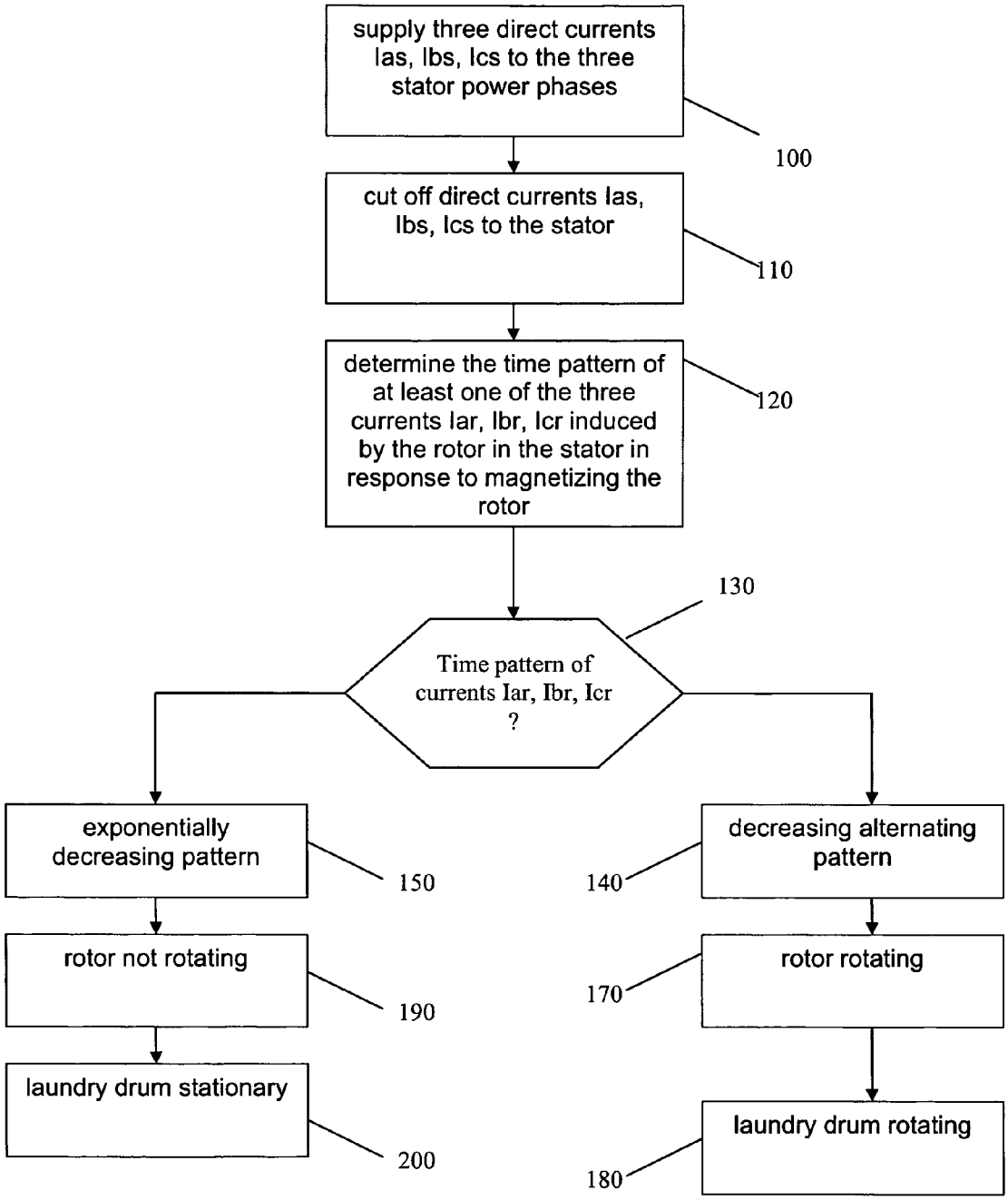
FIG. 7 shows a flow chart of the operations performed by the sensorless safety system to determine rotation of the laundry drum.

With reference to the FIG. 7 flow chart, in the event of power failure, control unit 21 closes switches 18 of power circuit 15 to inject stator phases 31 with the three currents Ias, Ibs, Ics (block 100).

In the FIG. 4 example, at the end of the power failure, i.e. when the electric household appliance is powered, the power circuit 15 injects the stator phases with the following currents: a current Ias of roughly 2 amperes, and currents Ibs and Ics of roughly −1 ampere.

The three injected currents Ias, Ibs, Ics magnetize rotor 32 of motor 6, and so produce a temporary build-up of energy.

After a predetermined magnetizing time interval ΔT, control unit 21 cuts off currents Ias, Ibs, Ics to stator phases 31, thus demagnetizing rotor 32 of motor 6 (block 110). At this stage, rotor 32 of three-phase asynchronous motor 6 discharges the energy accumulated during magnetization by injected currents Ias, Ibs, Ics, and the energy of the rotor induces currents Iar, Ibr, Icr in stator phases 31 of stator 30, the time pattern of which will depend on whether or not rotor 32 is rotating.

As stated, if rotor 32 is rotating, each current Iar, Ibr, Icr has a substantially alternating time pattern gradually decreasing in amplitude; whereas, conversely, i.e. if rotor 32 is stationary, the time pattern of each current decreases exponentially with time, with no zero crossings.

At this point, control unit 21 switches switches 18 to measure induced currents Iar, Ibr, Icr by means of the shunts (block 120), and processes the induced currents to determine their time pattern and accordingly determine rotation or no rotation of rotor 32 (block 130).

More specifically, as stated, in a preferred embodiment, control unit 21 determines the pattern of each current Iar, Ibr, Icr on the basis of its zero crossings ZC.

More specifically, given a sequence of zero crossings ZC, control unit 21 determines a substantially alternating current time pattern (block 140) produced by rotation of rotor 32; whereas, with no zero crossings, control unit 21 determines a substantially decreasing current time pattern produced by no rotation of rotor 32 (block 150).

It should be pointed out, however, that in a different embodiment, control unit 21 determines the pattern of each induced current using a current sampling procedure.

Once the time pattern of the induced currents is determined, control unit 21 generates state signal ST indicating rotation of the rotor (170) and therefore of the laundry drum (block 180), in the event of an alternating pattern.

And control unit 21 generates state signal ST indicating no rotation of the rotor (block 190) and therefore of the laundry drum (block 200), in the event the induced currents show an exponentially decreasing pattern.

Signal ST may be sent to a supervising unit 50 (FIG. 1), which prevents door 5 from being opened when signal ST indicates rotation of rotor 32 of three-phase asynchronous motor 6 and therefore rotation of laundry drum 3.

In connection with the above, it should be pointed out that control unit 21 may determine rotation of rotor 32 as described above on the basis of the time pattern of at least one of the induced currents, which means the sensorless safety system may comprise only one current-measuring module 20.

In addition to the above, it should be pointed out that the sensorless safety system can also advantageously determine the rotation speed of rotor 32 of motor 6 on the basis of the frequency of one of currents Iar, Ibr, Icr circulating in the stator phases and induced in the stator by the rotor.

The sensorless safety system described has the following advantages. Firstly, it is extremely cheap, by requiring no additional electronic components. That is, the sensorless safety system described comprises the electronic components of an inverter normally used to control the three-phase asynchronous motor, but in which the present invention conveniently provides, in the event of power failure, for implementing the described control procedure, which may obviously be predetermined in software/firmware stored in the control unit.

Secondly, injecting direct currents into the stator generates in the rotor, by virtue of it rotating, electromotive forces and, hence, currents, which, in accordance with Lenz's law, oppose the source generating them, i.e. rotation of the rotor. In other words, besides enabling rotation or no rotation to be determined, direct-current injection also produces a braking effect on the rotor, and hence on the laundry drum, which is extremely important from the safety standpoint of the washing machine in the event of power failure.

The invention claimed is:

1. An electric household appliance comprising a casing; a laundry drum mounted inside the casing to rotate about an axis of rotation; a three-phase asynchronous motor for rotating said laundry drum; and a sensorless safety system for determining rotation of the rotor of said three-phase asynchronous motor to determine rotation or no rotation of said laundry drum;

said sensorless safety system being configured to:

supply three direct currents (Ias, Ibs, Ics) to the three stator power phases of the stator of said three-phase asynchronous motor during a predetermined time interval (ΔT) at the end of a power failure, so as to magnetize the rotor of said three-phase asynchronous motor at the end of said power failure;

cut off supply of said direct currents (Ias, Ibs, Ics) to said stator at the end of said predetermined time interval (ΔT), whereupon energy accumulated during magnetization by the supplied currents is discharged, and determine the time pattern of at least one of the three induced currents (Iar, Ibr, Icr) induced in said stator in response to magnetizing the rotor; and determine rotation or no rotation of the rotor of said three-phase asynchronous motor at the end of said power failure on the basis of the time pattern of at least one of the three induced currents (Iar, Ibr, Icr) determined.

2. An electric household appliance as claimed in claim 1, wherein said sensorless safety system is configured to determine rotation of said rotor of said three-phase asynchronous motor when at least one of said induced currents (Iar, Ibr, Icr) has a substantially alternating pattern decreasing with time.

3. An electric household appliance as claimed in claim 1, wherein said sensorless safety system is configured to determine the zero crossings (ZC) of at least one of said three induced currents (Iar, Ibr, Icr), and determines the time pattern of the induced current on the basis of said zero crossings (ZC).

4. An electric household appliance as claimed in claim 1, wherein said sensorless safety system is designed to determine no rotation of said rotor of said three-phase asynchronous motor when at least one of said induced currents (Iar, Ibr, Icr) has a pattern decreasing substantially exponentially with time.

5. An electric household appliance as claimed in claim 4, wherein said sensorless safety system is designed to determine the zero crossings (ZC) of at least one of the three induced currents (Iar, Ibr, Icr), and determines a pattern of said induced current (Iar, Ibr, Icr) decreasing substantially exponentially with time, when said induced current (Iar, Ibr, Icr) has no zero crossings (ZC).

6. An electric household appliance as claimed in claim 2, wherein said sensorless safety system is designed to determine the rotation speed of said rotor on the basis of the number of zero crossings (ZC) measured within a predetermined measuring interval.

7. A method of determining rotation of a laundry drum of an electric household appliance, rotated about an axis by a three-phase asynchronous motor, said method comprising the steps of:

supplying three direct currents (Ias, Ibs, Ics) to the three stator power phases of the stator of said three-phase asynchronous motor during a predetermined time interval (ΔT) at the end of a power failure, so as to magnetize the rotor of said three-phase asynchronous motor at the end of said power failure;

cutting off supply of said direct currents (Ias, Ibs, Ics) to said stator at the end of said predetermined time interval (ΔT), whereupon energy accumulated during magnetization by the supplied currents is discharged, and determining the time pattern of at least one of the three induced currents (Iar, Ibr, Icr) induced in said stator in response to magnetizing the rotor; and determining rotation or no rotation of the rotor of said three-phase asynchronous motor at the end of said power failure on the basis of the time pattern of at least one of the three induced currents (Iar, Ibr, Icr) determined.

8. A method as claimed in claim 7, and comprising the step of determining rotation of the rotor of said three-phase asynchronous motor when at least one of said induced currents (Iar, Ibr, Icr) has a substantially alternating pattern decreasing with time.

9. A method as claimed in claim 7, and comprising the steps of: determining the zero crossings (ZC) of at least one of said three induced currents (Iar, Ibr, Icr); and determining the time pattern of the induced current on the basis of said zero crossings (ZC).

10. A method as claimed in any one of claim 7, and comprising the step of determining no rotation of said rotor of said three-phase asynchronous motor when at least one of said induced currents (Iar, Ibr, Icr) has a pattern decreasing substantially exponentially with time.

11. A method as claimed in claim 10, and comprising the steps of: determining the zero crossings (ZC) of at least one of the three induced currents (Iar, Ibr, Icr); and determining a pattern of said induced current decreasing substantially exponentially with time, when said induced current (Iar, Ibr, Icr) has no zero crossings (ZC).

12. A method as claimed in any one of claim 9, and comprising the step of determining the rotation speed of said rotor on the basis of the number of zero crossings (ZC) measured within a predetermined measuring interval.

13. An electric household appliance as claimed in claim 2, wherein said sensorless safety system is designed to determine no rotation of said rotor of said three-phase asynchronous motor when at least one of said induced currents (Iar, Ibr, Icr) has a pattern decreasing substantially exponentially with time.

14. An electric household appliance as claimed in claim 3, wherein said sensorless safety system is designed to determine no rotation of said rotor of said three-phase asynchronous motor when at least one of said induced currents (Iar, Ibr, Icr) has a pattern decreasing substantially exponentially with time.

15. A method as claimed in claim 8, and comprising the steps of: determining the zero crossings (ZC) of at least one of said three induced currents (Iar, Ibr, Icr); and determining the time pattern of the induced current on the basis of said zero crossings (ZC).

16. A method as claimed in any one of claim 8, and comprising the step of determining no rotation of said rotor of said three-phase asynchronous motor when at least one of said induced currents (Iar, Ibr, Icr) has a pattern decreasing substantially exponentially with time.

17. A method as claimed in any one of claim 9, and comprising the step of determining no rotation of said rotor of said three-phase asynchronous motor when at least one of said induced currents (Iar, Ibr, Icr) has a pattern decreasing substantially exponentially with time.

18. A method as claimed in any one of claim 15, and comprising the step of determining no rotation of said rotor of said three-phase asynchronous motor when at least one of said induced currents (Iar, Ibr, Icr) has a pattern decreasing substantially exponentially with time.

19. A method as claimed in claim 10, and comprising the step of determining the rotation speed of said rotor on the basis of the number of zero crossings (ZC) measured within a predetermined measuring interval.

20. A method as claimed in claim 11, and comprising the step of determining the rotation speed of said rotor on the basis of the number of zero crossings (ZC) measured within a predetermined measuring interval.

* * * * *